United States Patent [19]

Marchione

[11] Patent Number: 4,744,115

[45] Date of Patent: May 17, 1988

[54] PATIENT MOVER

[76] Inventor: Robert L. Marchione, 38 Kenrick St., Brighton, Mass. 02135

[21] Appl. No.: 88,966

[22] Filed: Aug. 24, 1987

[51] Int. Cl.[4] ..... A61G 7/08; A61G 1/00

[52] U.S. Cl. ..... 5/81 R; 5/81 B; 5/82 R

[58] Field of Search ..... 5/81 R, 81 B, 81 C, 5/82 R, 89

[56] References Cited

U.S. PATENT DOCUMENTS

| | | | |
|---|---|---|---|
| 618,274 | 1/1899 | Jones | 5/82 |
| 675,409 | 6/1901 | Pettee | 5/82 |
| 841,702 | 1/1907 | Martin | 5/89 |
| 1,207,750 | 12/1916 | Gwin | 5/82 |
| 4,283,068 | 8/1981 | Keyser | 5/82 R X |

FOREIGN PATENT DOCUMENTS

| | | | |
|---|---|---|---|
| 1007768 | 3/1977 | Canada | 5/81 B |

*Primary Examiner*—Alexander Grosz
*Assistant Examiner*—Michael F. Trettel
*Attorney, Agent, or Firm*—William Nitkin

[57] ABSTRACT

An apparatus for moving a patient from one supporting surface to another supporting surface, having a pair of rigid panels positioned apart from one another sandwiched between an upper and lower cover sheet which are attached together retaining the panels therebetween in position with the outer corners of each panel cut at an angle causing the cover sheets beyond each angular cut to contact one another with hand-hold apertures formed in each corner where the cover sheets contact one another.

3 Claims, 1 Drawing Sheet

PATIENT MOVER

BACKGROUND OF THE INVENTION

1. Field of the Invention

The apparatus of this invention resides in the area of patient movers and more particularly relates to a planer structure which is utilized for moving a patient from one supporting surface to an adjacent supporting surface.

2. Description of the Prior Art

Patient moving apparatus are well known in the prior art. They are utilized to move a patient, for example, from a bed to an adjacent supporting surface such as a gurney; to transport the patient elsewhere within a hospital or other institution; or to move a patient from one bed to another. Also such patient movers are utilized to move a patient from a gurney to an x-ray table where it is desirable that the patient mover be essentially radiolucent so that the apparatus does not have to be removed from under the patient when the patient is x-rayed in place thereon. Sheets are commonly used as patient movers whereby hospital employees will grasp the sides of the sheet with the patient thereon and then slide the sheet with the patient thereon from, for example, a bed to another supporting surface, such as a gurney. Sheets, however, lack rigidity on which to partially support the patient during such move, and they also do not have convenient grasping means other than by bunching the sheet's end in one's hand for the lifting and moving.

In an effort to provide easier and safer means of patient moving from one supporting surface to another, many devices have been produced over the years, for example, the Patient Shifting Aid and Method of Buchman, U.S. Pat. No. 4,067,079 which discloses a plastic slab having hand-hold openings along its sides. The patient is placed on the slab and pulled from one supporting surface to another more easily because the slab has a smooth sliding bottom surface to minimize frictional resistance to the sliding movement of the patient mover with the weight of the patient thereon. Another such device is a patient transfer mattress called a Trans-Mat made by Victoreen, Inc. which is indicated as patent pending and which is a mat with padding in the center with hand-holds around the edges and solid plastic members in the hand-holds so that the hand-holds will not crimp or close against the carriers' hands. This feature is useful as this device is designed to be lifted and not slid. A patient is placed thereon and then lifted and carried from one surface to the other. This method, though, might be inconvenient if the staff members moving the patient have insufficient strength to lift the patient or if there is only one staff person to do the moving. Thus in many instances the sliding type of patient mover is more desirable.

Other types of patient movement apparatus are known such as devices having a series of rollers therein. Such devices are slipped under the patient and rollers surrounded by a cover cause the movement thereround of the cover material which allows the patient to be "rolled" on the device from one supporting surface to another. These devices, though, are heavy and rigid and can be difficult to handle and maneuver successfully.

There are other structures utilized for moving patients which combine the features of rollers or planer members such as U.S. Pat. No. 3,962,736 to Fedele for a Device for Moving or Positioning a Patient in a Bed or U.S. Pat. No. 3,829,914 to Treat for a Patient Positioning Device which device facilitates longitudinal shifting of a patient on a bed, such device being a planar sheetlike member having a slippery bottom surface and a higher-friction top surface to retain the patient thereon while allowing the structure to be slid longitudinally on a bed. Such a device also can be used for tranverse shifting and for lifting if enough individuals are available to use all the hand-holds of the device.

It should be noted that patient moving devices are distinguishable in the art from stretcher and litter devices because stretchers and litters are adapted to support the patient independently of the underlying supporting surface, and a patient can be transported thereon away from the underlying bed or supporting surface. Patient-moving devices are only utilized for transportation of the patient from one supporting surface to an adjacent supporting surface with the underlying surfaces always providing the necessary support to hold the patient and the patient-moving device being merely the means to transport the patient easily by sliding from one surface to the other.

SUMMARY OF THE INVENTION

It is an object of this invention to provide an improved patient mover that is simple in construction and easier to store than the large structures of the prior art.

It is a further object of this invention to provide a patient mover that is easy to manipulate and radiolucent so that it does not have to be removed from under a patient during x-ray procedures.

The patient mover of this invention includes first and second rigid and substantially rectangular panels arrayed end-to-end with a space defined therebetween with a substantially rectangular upper cover sheet of nylon-like material and a substantially rectangular lower cover sheet of similar material thereunder. The first and second panels are stitched or otherwise retained in position between the upper and lower sheets. The first and second panels are spaced apart a distance along their inner ends corresponding to the midline of the device, which area when sandwiched by the flexible upper and lower cover sheets allows the device to be folded in the middle for easy storage. The outer ends of each of the first and second panels have their corners cut at an angle leaving a cover sheet spatial area where the cover sheets contact one another beyond the panel corners as the cover sheet members are essentially rectangular with rounded corners. A hand-hold is defined in each cover sheet spatial area at the corners of the device. A pair of mating hook and pile strips (sold under the trademark Velcro), snaps or equivalent releasable attachment members are positioned on either the upper or lower cover sheets beyond the outer ends of the first and second panels between the panel angular edge cuts which outer ends are parallel to the inner ends of each panel and perpendicular to the sides thereof so that when the structure is folded on its midline center seam, the Velcro strips will mate and hold the structure folded together to make it more compact for easier storage and handling thereof. A pair of strap members can be attached by stitching, adhesive or equivalent means to the bottom of the lower cover sheet, each strap positioned under a panel and each extending beyond the sides of the cover sheets will end loop handles formed at each end of such straps. Such straps can be optionally utilized under each of the panels in a central position to aid in the pulling of the patient from one surface to another. It should be noted, as mentioned in the Description of the Prior Art above, that patient movers are not designed to be utilized as a litter nor are they designed for transporting a patient thereon apart or separate from the underlying support of beds, stretchers, gurneys or the like. The device of this invention is intended for the tranfer or movement of the patient from one support surface to an adjacent support surface. Further, if the covers of this invention are made of nylon fabric or equivalent material, it will have a slippery bottom surface which will easily slide on the underlying supporting surface.

DESCRIPTION OF THE PREFERRED EMBODIMENT(S)

Figure 1:
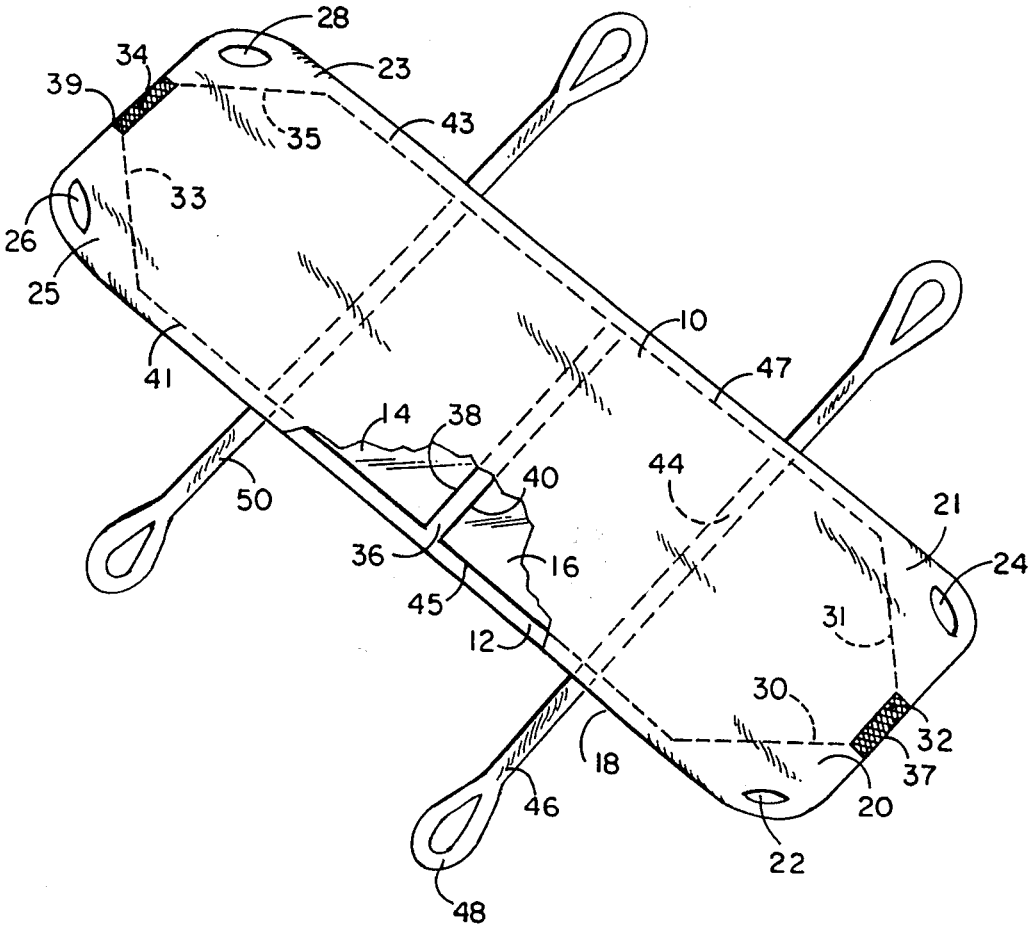
FIG. 1 is a perspective view of the device of this invention with portions cut away to expose some of the interior structure thereof.

FIG. 1 illustrates a perspective cutaway view of the device of this invention showing first panel 14 and second panel 16, each of approximately half the size of the device. These panels can be made of thin plastic or other stiff planar material having strength and rigidity such as metal, thin plywood or any other equivalent material. These panels are essentially rectangular in configuration having first inner end 38 and second inner end 40 positioned apart from one another in parallel relationship a short distance such as an inch or two at the device's midline to form center seam 36 therebetween as will be described in dtail below. The outer corner ends of each panel are cut at an angle forming panel angular edges 30, 31, 33 and 35 and outer ends 37 and 39 which outer ends are parallel to first and second inner ends 38 and 40. Below and above panel members 14 and 16 are respectively positioned lower cover sheet 12 and upper cover sheet 10 which can be of a flexible low-friction nylon cloth or equivalent material which extend beyond the outer edges and sides of both panels and which can be stitched or held tother by other equivalent means such as heat-welding or adhesive, sandwiching first and second panels 14 and 16 in position therebetween and retaining first and second panels 14 and 16 fixedly therbetween so that they do not slide or move between the upper and lower cover sheets. The cover sheets extend beyond sides 41, 43, 45 and 47 and outer ends 37 and 39 of first and second panels 14 and 16. The cover sheets can have rounded corners. In the areas beyond each panel's angular edges 30, 31, 33 and 35 at each of the four corners of the cover sheets where upper cover sheet 10 and lower cover sheet 12 come together without any portion of the panel members therebetween are formed four cover sheet spatial contact areas 20, 21, 23 and 25. Within each cover sheet's spatial contact area 20, 21, 23 and 25 is an aperture forming hand-holds 22, 24, 26 and 28. These hand-holds allow for the grapsing of the device at the corners for aid in moving a patient from one supporting surface to another. At both ends of upper cover sheet 10 extending beyond outer end 39 of first panel 14 and outer end 37 of second panel 16 are mating hook and loop fastener members such as Velcro members 34 and 32, respectively, or equivalent releasable attachment means which are adapted to interlock with one another when the device is folded at center seam 36 when the first panel is swung up adjacent to and folded flat against the second panel and the Velcro mating strips 32 and 34 are mated. These mating strips can also be positioned on the lower cover sheet so that the device can be folded in the other direction. Once folded, the device takes up half the space taken up in its open mode and allows for much easier storing and handling thereof than the large non-folding devices of the prior art. Disposed under lower cover sheet 12 can be, in some embodiments, strap members which are sewn or affixed by other equivalent means. These straps, such as straps 46 and 50, extend beyond the sides of the upper and lower cover sheets and terminate with loop handles such as loops 48 at their ends. These strap members can be utilized to assist in grapsing and pulling of the device for easy movement of the patient mover of this invention from one supporting surface to another although the device in some instances may not utilize such straps. It should be noted that the surface of the nylon or equivalent material of the lower cover sheet is very slippery and greatly reduces friction when slid from one supporting surface to another. The first and second panels are utilized to add rigidity to the structure to make it easier to use and their rigidity allows the apparatus of this invention to be quickly and easily placed under the patient by rolling the patient toward one side slightly and then sliding the patient mover of this invention under the patient. One then rolls the patient back onto the device. These rigid panels make it easier to move this device under the patient than if the panels were constructed of limp flexible fabric which would have to be straightened and aligned under the patient. Further, the hand-holds at the corners of the device are not utilized to lift a patient but to be grasped and pulled to slide the patient on the device of this invention across to the adjacent support surface to which the patient is being transferred. The device of this invention can even be utilized by one attendant standing beyond the supporting surface to which the patient is to be moved by pulling on each loop handle of straps 46 and 50 and can thereby move a patient of average size without assistance.

Although the present invention has been described with reference to particular embodiments, it will be apparent to those skilled in the art that variations and modifications can be substituted therefor without departing from the principles and spirit of the invention.

I claim:

1. An apparatus for moving a patient from one supporting surface to another supporting surface, comprising:

a first substantially rectangular rigid panel having two parallel sides and parallel outer and inner ends;

a second substantially rectangular rigid panel having two parallel sides and parallel outer and inner ends positioned with its inner end aligned with and spaced apart a short distance from the inner end of said first panel;

a lower cover sheet of substantially rectangular low-friction material of a size when placed under said first and second panels as to extend beyond the sides and ends of said panels when aligned thereunder, said cover sheet having rounded corners;

an upper cover sheet of material substantially the size of said lower cover sheet positioned on top of said first and second panels, said upper and lower cover sheets being attached to one another at their periphery beyond the sides and edges of said first and second panels and through the space defined between the inner ends of said panels;

the corners of the outer ends of said first and second panels being cut to form angular edges allowing portions of said cover sheets to contact one another at such outer end corners to form cover sheet spatial contact areas which have no panel members therebetween;

four hand-hold apertures each defined at the corners of said device in said cover sheet spatial contact areas, said hand-holds adapted for grasping by the user; and a pair of releasable mating attachment means each positioned at both ends of a cover sheet and at the outer ends of each panel between the areas of the panel angular edge cuts, said apparatus being adapted to fold at a seam formed between said first and second panels, said seam being formed by said upper and lower cover sheets where they extend over the space defined between the inner ends of said first and second panels, said device further adapted for said attachment means to mate and releasably hold said folded structure together when folded along said seam for storage and handling of said device, said attachment means being releasable for said device to be unfolded for usage.

2. The apparatus of claim 1 further including:

first and second strap members, each extending perpendicular to and beyond the sides of said cover sheets and passing under said device, said first and second strap members being affixed thereto and positioned respectively under said first and second panels; and end loop handles formed on the ends of each of said strap members to assist a user in grasping and moving the apparatus.

3. The apparatus of claim 1 wherein the materials of the contruction of said apparatus are radiolucent for use with x-ray apparatus.

* * * * *